US006419419B1

(12) United States Patent
Kelsay, III

(10) Patent No.: US 6,419,419 B1
(45) Date of Patent: Jul. 16, 2002

(54) BLADE FOR MOTORIZED TROWEL

(75) Inventor: Gordon Kelsay, III, Glasgow, KY (US)

(73) Assignee: Smith and Kelsay Mfg., Glasgow, KY (US)

( * ) Notice: Subject to any disclaimer, the term of this patent is extended or adjusted under 35 U.S.C. 154(b) by 0 days.

(21) Appl. No.: 09/793,932

(22) Filed: Feb. 27, 2001

(51) Int. Cl.[7] ..... E01C 19/22
(52) U.S. Cl. ..... 404/112
(58) Field of Search ..... 404/112, 118; 451/353; 15/235.4

(56) References Cited

U.S. PATENT DOCUMENTS

| | | | | | |
|---|---|---|---|---|---|
| 162,355 | A | * | 4/1875 | Disston | 15/235.4 |
| 938,070 | A | * | 10/1909 | Neerup | 15/235.4 |
| 2,108,470 | A | * | 2/1938 | Boulton | 144/119.1 |
| 2,198,929 | A | | 4/1940 | Whiteman | |
| 2,556,983 | A | | 6/1951 | Root | |
| 2,662,454 | A | | 12/1953 | Whiteman | |
| 2,689,507 | A | | 9/1954 | McCrery | |
| 2,865,269 | A | | 12/1958 | McMillan | |
| 2,888,863 | A | | 6/1959 | Eisenbeis | |
| 3,375,766 | A | | 4/1968 | Zochil | |
| 3,683,761 | A | | 8/1972 | Babic | |
| 4,388,017 | A | * | 6/1983 | Morrison | 404/112 |
| 4,556,339 | A | * | 12/1985 | Morrison | 15/235.4 |
| 4,859,115 | A | | 8/1989 | Morrison | |
| 5,906,455 | A | * | 5/1999 | McLaughlin | 15/235.4 |

* cited by examiner

*Primary Examiner*—Gary S. Hartmann
(74) *Attorney, Agent, or Firm*—Theresa Fritz Camoriano; Camoriano and Associates

(57) ABSTRACT

A trowel machine has replaceable blades. In a preferred embodiment, the blade can be replaced separately from its backing bar, and the same fasteners that secure the blade to the backing bar also secure the blade to the trowel arm of the machine. In a preferred embodiment, the blade is deformed in the area of the mounting holes, providing a clamping surface recessed from the working surface of the blade to provide retention of the blade on the trowel machine.

11 Claims, 6 Drawing Sheets

BLADE FOR MOTORIZED TROWEL

BACKGROUND OF THE INVENTION

The present invention relates to motorized trowels for smoothing concrete, and, in particular, to a new trowel blade. In the prior art, each trowel blade is riveted onto a backing bar, which, in turn, is bolted onto an arm of the motorized trowel machine. There are problems with that arrangement. First, as the machine rotates the blades to smooth the concrete surface, the bottom surface of each blade wears, and the head of the rivet also wears. The head of the rivet is flush with the bottom of the trowel and contacts the blade only along the thickness of the blade, which is a very small area. As the blade and rivet wear, the blade can come loose from the machine, which is undesirable. Second, when the blade wears out (and these blades wear out frequently, approximately every two weeks for a machine that is in regular use), the entire blade, including the backing bar, must be thrown out in order to replace the blade, which is expensive.

SUMMARY OF THE INVENTION

The preferred embodiments of the present invention provide a more secure retention mechanism between the trowel blade and the backing bar and permit the trowel blade to be removed from its backing bar when the blade wears out and a new blade to be inserted in its place without having to replace the backing bar. Thus, as the blade wears out, it is much less likely to come loose from the machine, and replacing a worn blade is substantially less expensive and less wasteful of material than in the prior art.

DESCRIPTION OF THE PREFERRED EMBODIMENTS

Figure 1:
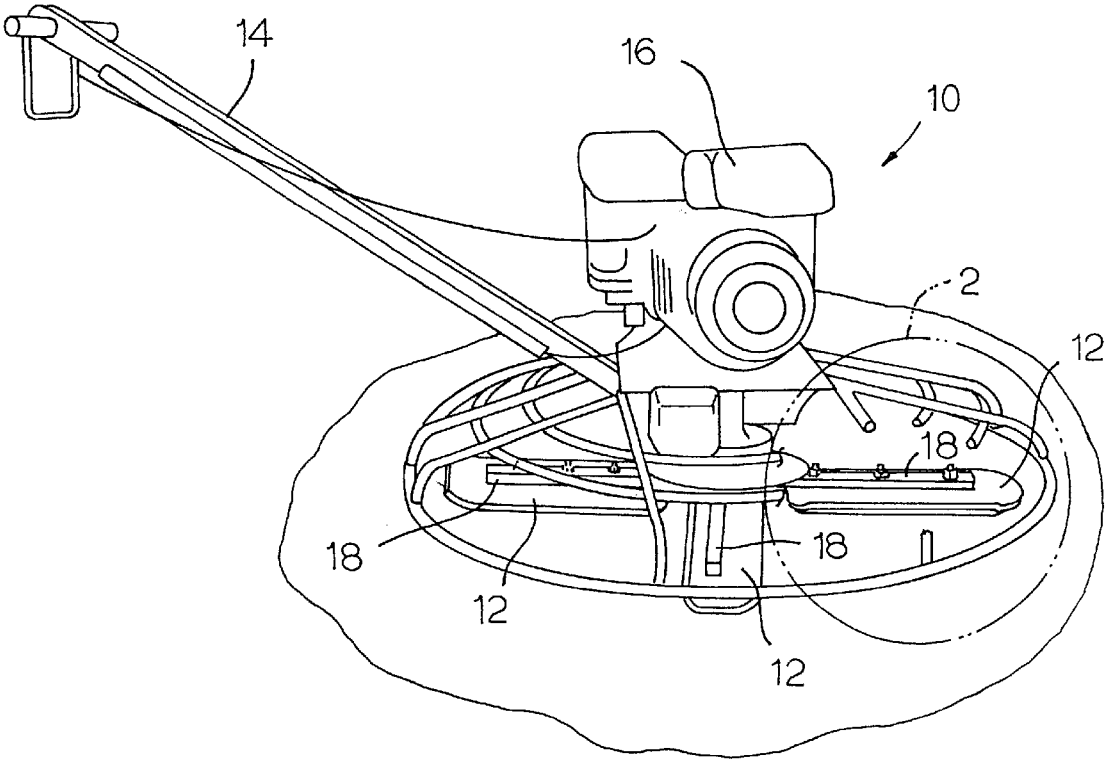
FIG. 1 shows a motorized trowel machine on which are mounted trowel blades made in accordance with the present invention.
Figure 2:
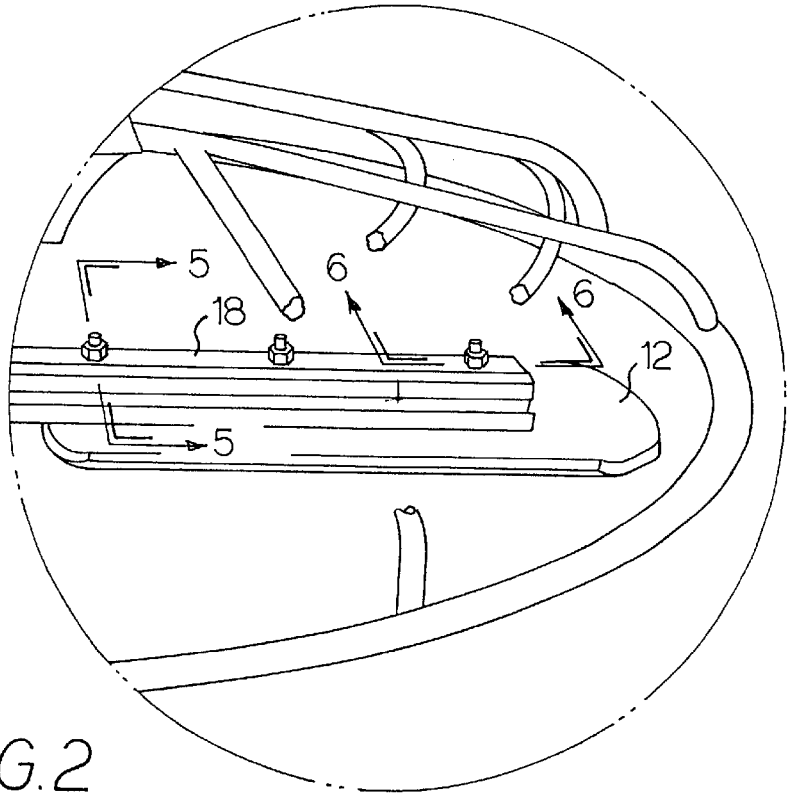
FIG. 2 is an enlarged view showing one of the blades of FIG. 1.

FIGS. 1 and 2 show a motorized trowel machine 10 on which are mounted trowel blades 12 made in accordance with the present invention. The machine 10 includes a handle 14, and a motor 16, which has an output shaft (not shown) on which are mounted radiall-extending trowel arms 18.

Figure 4:
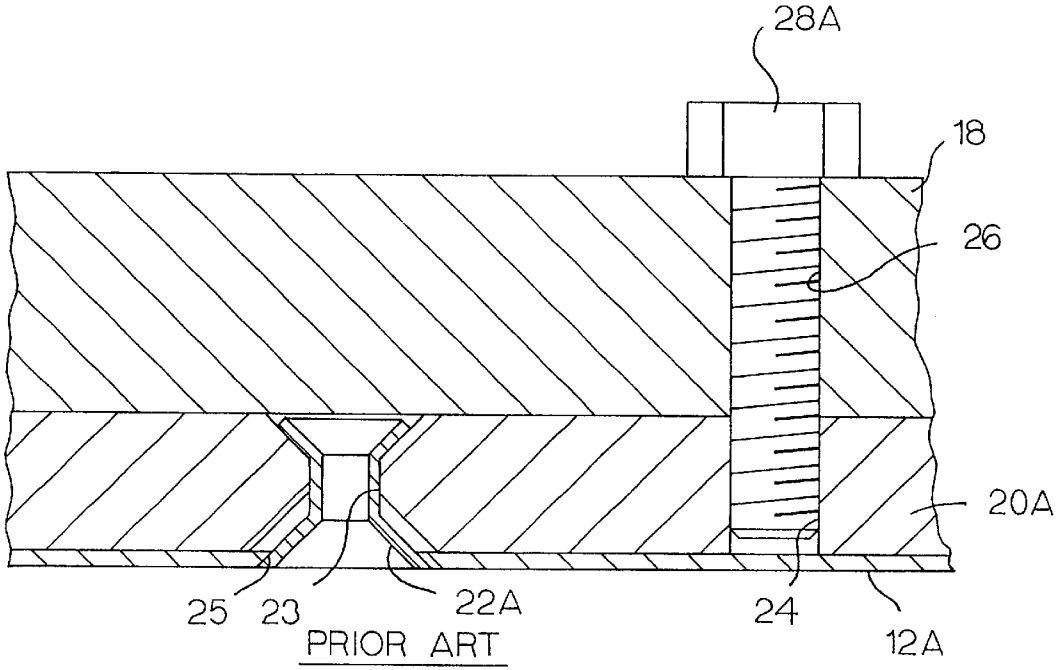
PRIOR ART FIG. 4
FIG. 4 is a sectional view of a prior art blade mounted on a machine of the type shown in FIG. 1 and taken along the same direction as FIG. 6.
Figure 3:
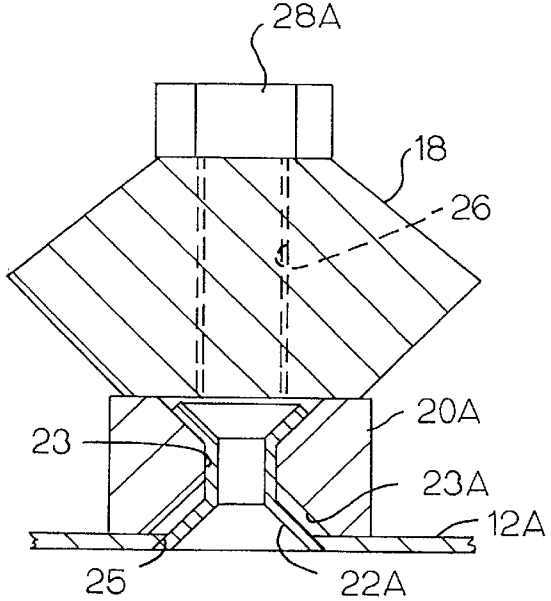
PRIOR ART FIG 3
FIG. 3 is a sectional view of a prior art blade mounted on a machine of the type shown in FIG. 1 and taken along the same direction as FIG. 5.
Figure 6:
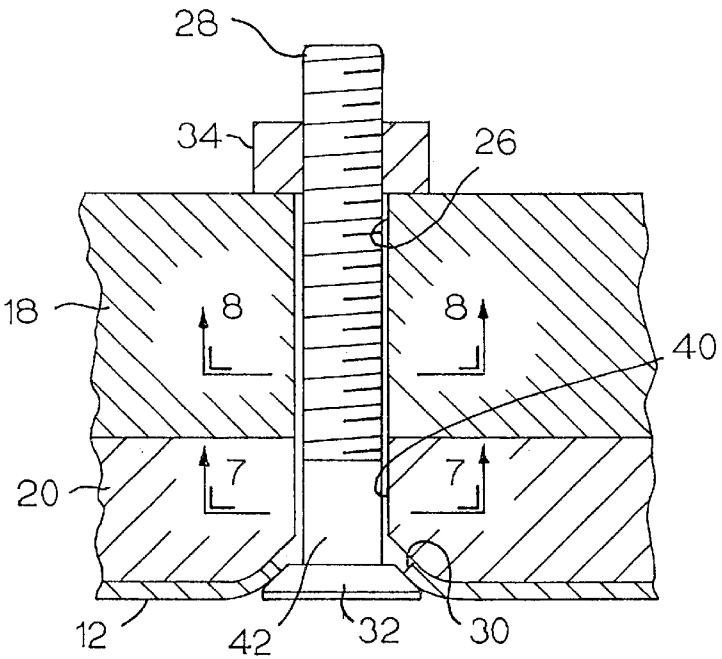
FIG. 6 is a view taken along the section 6—6 of FIG. 2.
Figure 8:
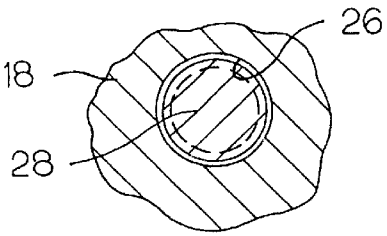
FIG. 8 is a view taken along the section 8—8 of FIG. 6.
Figure 5:
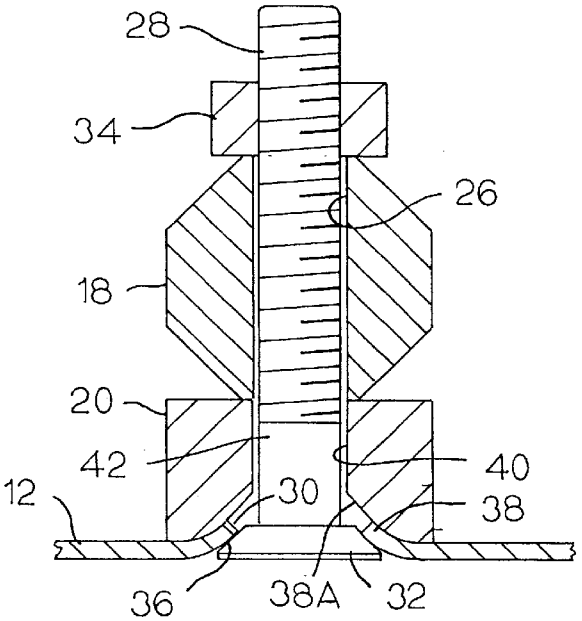
FIG. 5 is a view taken along the section 5—5 of FIG. 2.
Figure 7:
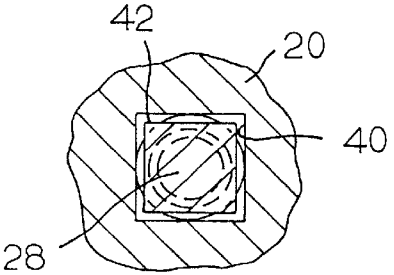
FIG. 7 is a view taken along the section 7—7 of FIG. 6.

FIGS. 3 and 4 show a prior art blade 12A mounted on a trowel arm 18 in the place of the blades 12 of FIGS. 1 and 2. In that prior art arrangement, the blade 12A is riveted onto a backing bar 20A by means of rivets 22A extending through holes 23 in the backing bar and holes 25 in the blade 12A. The top and bottom surfaces of the backing bar 20A define tapered indentations 23A around each hole 23, which allows the heads of the rivets 22A to be countersunk into the backing bar 20A. The thin-walled rivet head holds the blade 12A onto the backing bar 20A of the flat sheet 12A at the hole 25, providing little contact surface. Also, all of the contact surface which retains the blade on the backing bar 20A is located at the normal working thickness of the flat blade, and, as the blade wears, the connection holding the blade onto the machine also wears. The thin-walled head of the rivet 22A also erodes as the blade erodes. There is an air gap between the rivet head and the indentation 23A in the bottom surface of the backing bar 20A, so the blade 12A is just hanging onto the rivet head along a very thin edge of the flat blade and is pressed against the flat bottom surface of the backing bar 20A.

The backing bar 20A has threaded holes 24, which are separated from the rivet holes 23, and which are aligned with holes 26 through the trowel arm 18. Bolts 28A extend downwardly from the top surface of the trowel arm 18, through the holes 26 in the trowel arm, and are threaded into the threaded holes 24 of the backing bar 20A to fasten the trowel blade 12A onto the trowel arm 18. The holes 25 in the trowel blade 12A are not aligned with these holes 24, 26 in the backing bar 20A and the trowel arm 18, respectively.

FIGS. 5–8 show the details of a preferred mounting arrangement made in accordance with the present invention for mounting the blades 12 on the trowel arms 18. This arrangement differs from the prior art arrangement of FIGS. 3 and 4 in several respects.

The bolts 28 which hold the blades 12 onto the trowel arms 18 extend not only through the trowel arm 18 and the 20 backing bar, but also through holes 30 in the trowel blade 12, so the holes 30 in the trowel blade 12 are aligned with the holes 26 in the trowel arm 18. Instead of extending downwardly, as in the prior art, the bolts 28 extend upwardly, with the heads 32 of the bolts 28 in contact with the trowel blade 12, and nuts 34 are threaded onto the ends of the bolts 28 on top of the trowel arm 18. The result is that the same fastener 28 that holds the blade 12 onto the backing bar 20 also holds the blade 12 onto the trowel arm 18.

Figure 9:
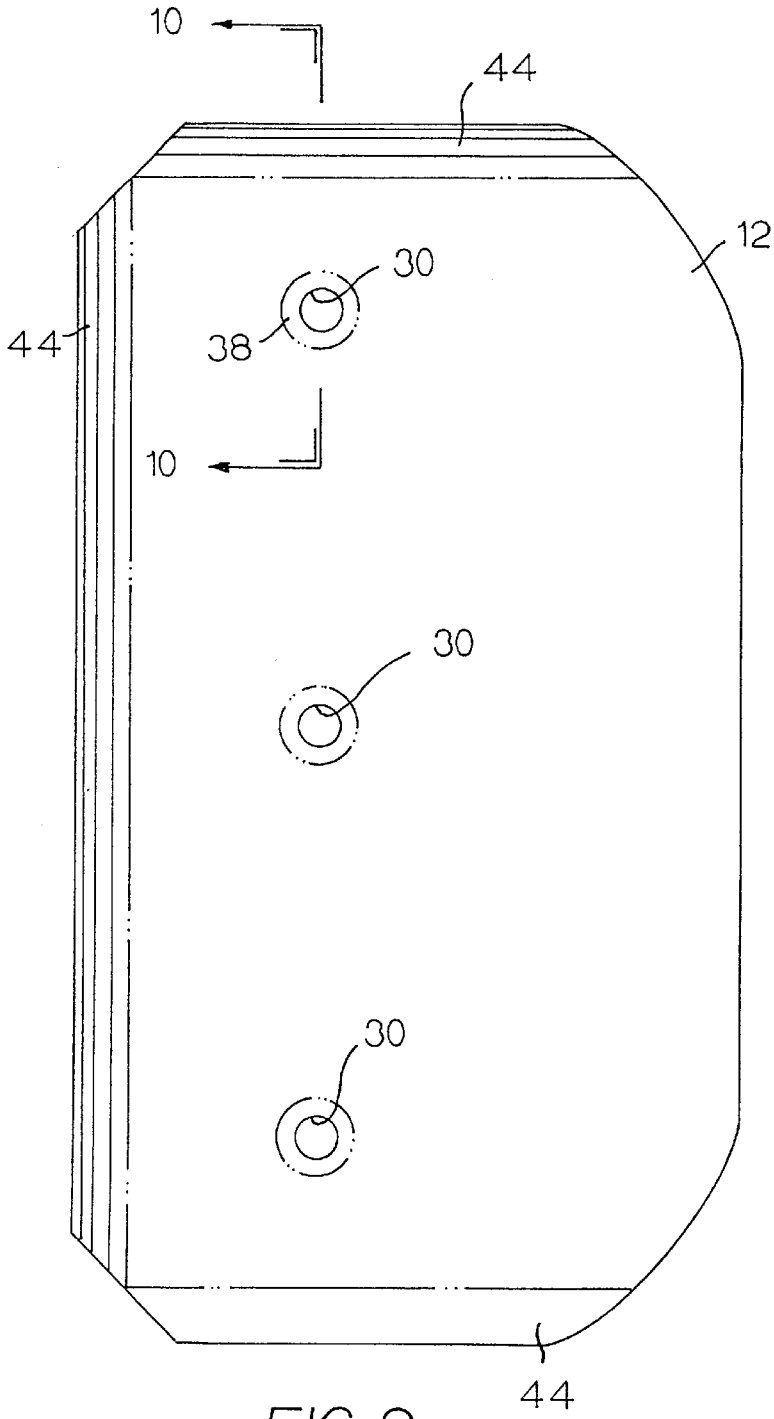
FIG. 9 is a top view of the blade of FIG. 1.
Figure 10:
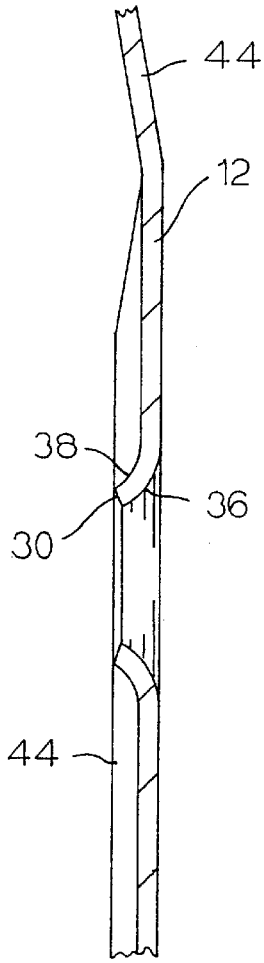
FIG. 10 is a view taken along the section 10—10 of FIG. 9.
Figure 11:
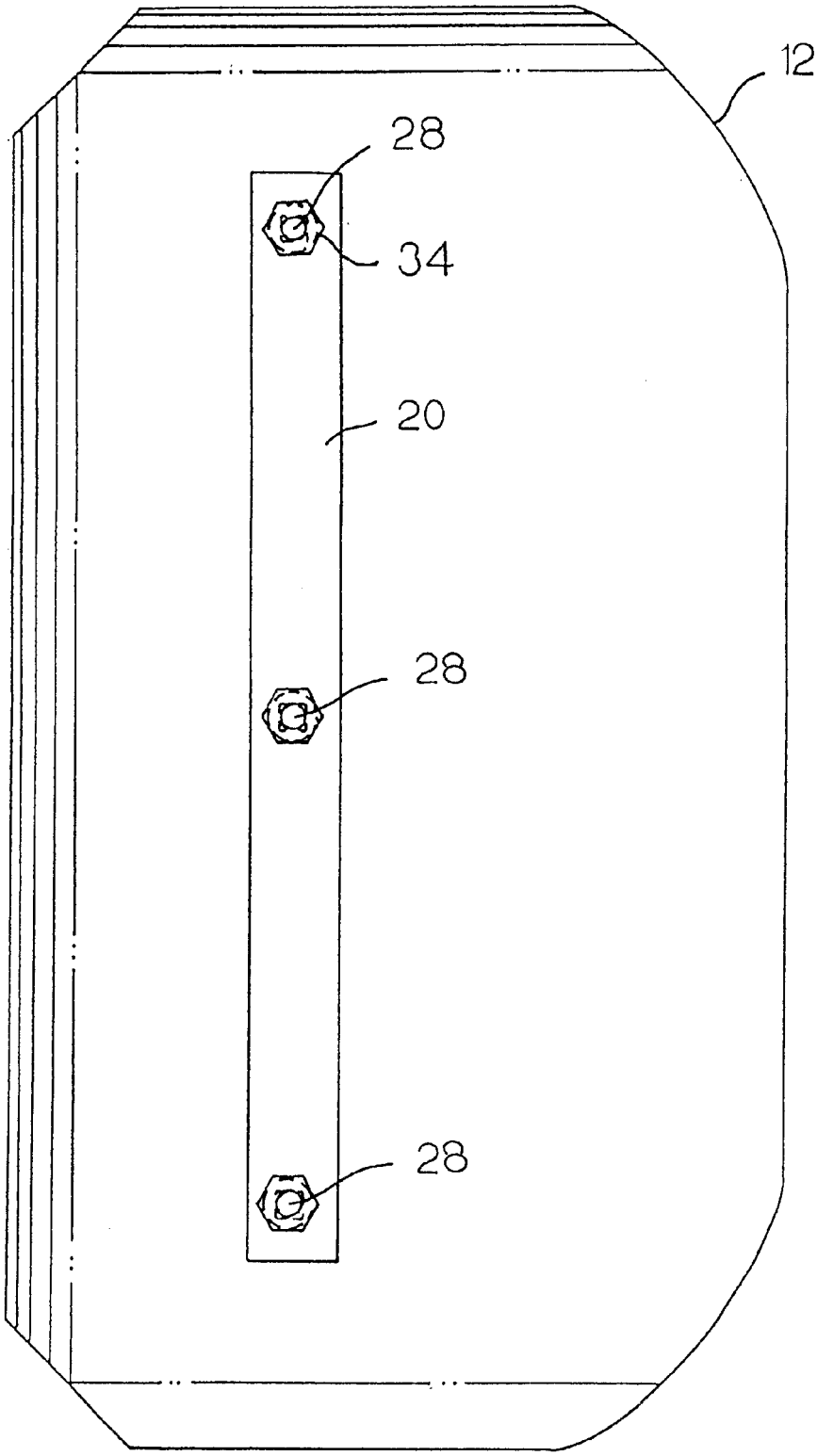
FIG. 11 is a top view of the backing bar and blade from the machine of FIG. 1, with the trowel arm removed for clarity.

In this preferred embodiment, the generally flat blade 12 is deformed upwardly in the area of the holes 30 to form tapered recesses 36 in its bottom surface and tapered projections 38 in its top surface around the holes 30. These projections and recesses are shown in more detail in FIG. 10. The blade 12 may also be deformed upwardly along its edges 44, as shown in FIGS. 9–11. The backing bar 20 has openings 40, and its bottom surface also defines a tapered recess 38A surrounding each opening 40. The countersunk portions or tapered recesses 38A in the bottom surface of the bar 20 receive the tapered projections 38 of the blade 12 with a snug fit. This provides a much larger surface area of contact between the bolt head 32 and the blade 12, provides clamping of the blade 12 to the countersunk surface 38A of the backing bar 20, provides a solid bolt head as opposed to a thin-walled rivet, and provides clamping contact between the bolt head 32, blade 12 and backing bar 20 in an area recessed from the normal flat portion of the blade so that, even as the blade wears and the flat surface of the bolt head wears, the blade 12 is securely fastened to the backing bar 20 and to the trowel arm 18. The outer surface of the head 32 preferably is flat, and the sides of the head 32 are tapered in a shape corresponding with the taper of the recesses 36.

The openings 40 in the backing bar 20 preferably are non-cylindrical, and the bolts 28 have a corresponding non-cylindrical neck portion 42 between the head 32 and the threaded end of the bolt to prevent the bolts 28 from rotating relative to the backing bar 20. In this embodiment, the openings 40 and the neck 42 have a square cross section, but they could have other non-cylindrical cross sections, such as hexagonal or defining some type of keyway.

FIGS. 9 and 10 show the trowel blade 12. This particular blade 12 has upwardly curved edges 44. In this embodiment, the projections 38 on the upper surface of the blade 12 extend approximately to the same height as the upwardly-curved edges 44. In the embodiment of FIG. 9, it can be seen that the holes 30 are in line and are spaced along the elongated direction of the blade 12. These holes 30 are positioned so they will be aligned with the trowel arm 18 of the machine on which the trowel blade 12 is to be mounted.

FIG. 11 shows a top view of the installed blade 12, with the trowel arm 18 removed to reveal the backing bar 20. This view shows the nuts 34, which are located above the trowel arm 18 when the blade 12 is assembled onto the machine.

Figure 12:
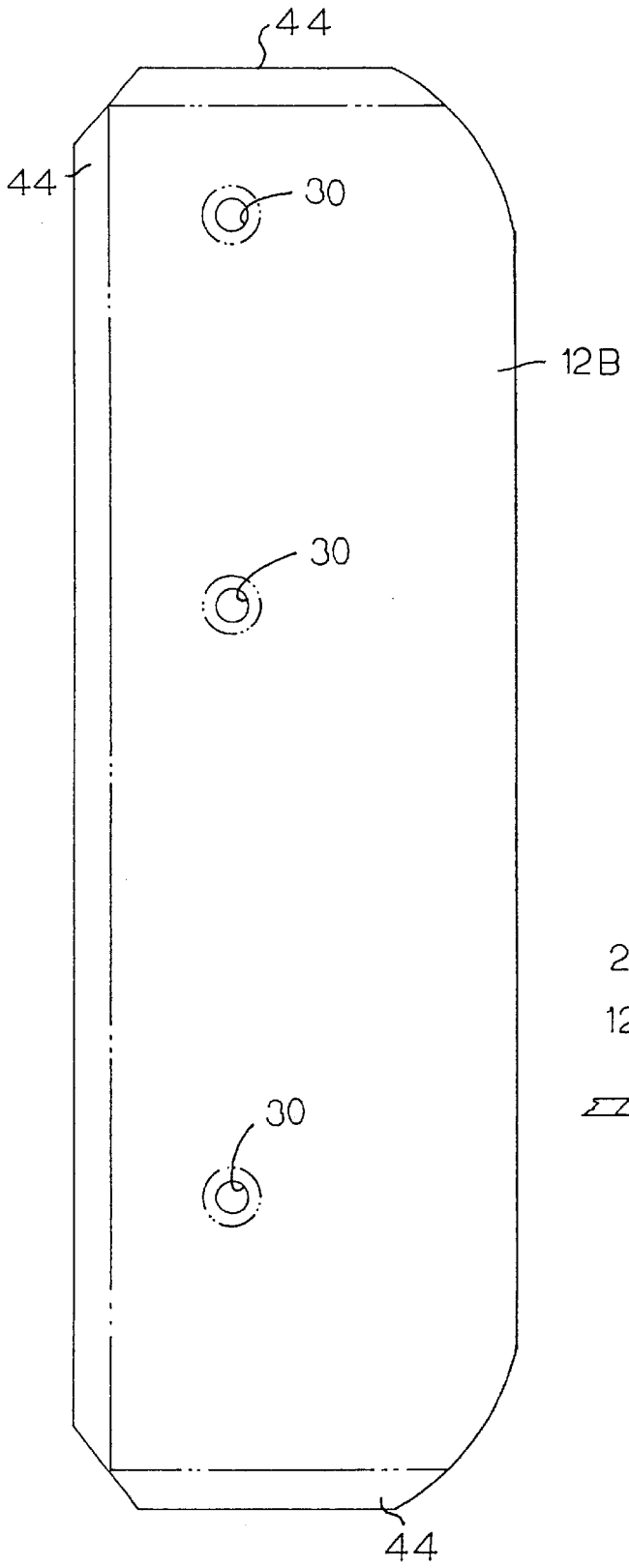
FIG. 12 is a top view of an alternative trowel blade made in accordance with the present invention.

FIG. 12 shows a top view of another embodiment of a blade 12B made in accordance with the present invention. This trowel blade 12B has a different length and shape from the first blade 12, which makes it suitable for mounting on a different type of trowel arm 18, and the in-line holes 30 are spaced differently along the elongated direction of the blade 12B. Again, these holes 30 are located in order to be aligned with the corresponding backing bar and trowel arm.

Figure 13:
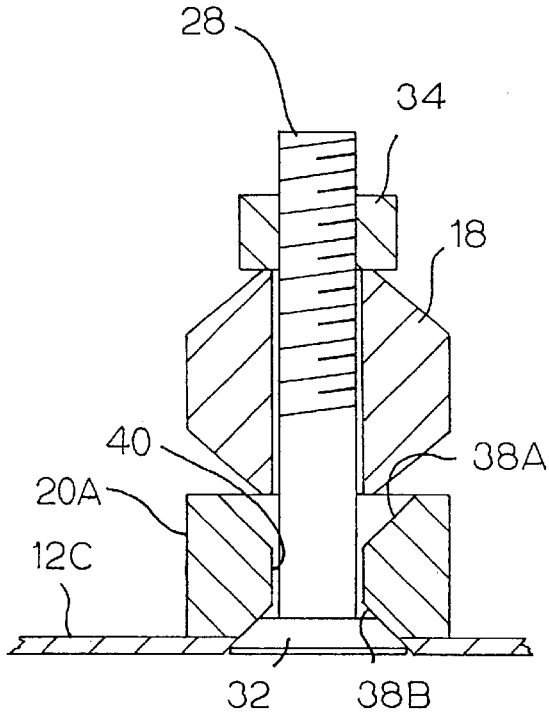
FIG. 13 is a sectional view of another mounting arrangement made in accordance with the present invention.

FIG. 13 shows an alternative mounting arrangement for mounting a finishing blade 12C. In this arrangement, the backing bar 20A has a larger diameter recess 38A surrounding the hole 40 on one surface and a smaller diameter recess 38B surrounding the hole 40 on the opposite surface. The first recess 38A is identical to the recess 38A described with respect to FIGS. 5–8. The second recess 38B is large enough to accommodate a portion of the solid head 32 of the bolt 28, but it is not large enough to receive the projection 38 from the trowel blade 12. The reason for the difference in the second recess 38B is that this side of the backing bar 20A is intended to receive a flat finishing blade 12C, which does not have projections in its top surface. While this mounting arrangement does not have all the advantages of the arrangement of FIGS. 5–8, it does provide a solid surface to receive the tapered bolt head 32 and the flat top surface of the blade 12C, which is far superior to the prior art arrangement of FIGS. 3 and 4, which left an air gap above the rivet and flat blade. Also, the use of a solid-headed bolt is superior to the use of a thin-walled rivet. So, the backing bar 20A of FIG. 13 can be used to mount two types of blades. It can be used as shown in FIG. 13 to mount a flat blade that does not have projections on its top surface surrounding the holes, and it can be inverted and used to mount a blade with projections as shown in FIGS. 5–8.

In these preferred embodiments, when the fasteners 28 are removed in order to remove the blade 12 from the trowel arm 18 so the blade can be replaced, the blade 12 also becomes separated from the backing bar 20. Thus, in this arrangement, only the blade 12 needs to be replaced—not the blade 12 and backing bar 20 combination as was required in the prior art. This saves substantial money and material over the design shown in FIGS. 3 and 4 in which, in order to replace the blade 12A, its associate backing bar 20A must also be replaced.

It will be obvious to those skilled in the art that modifications may be made to the embodiments described above without departing from the scope of the present invention. For example, while bolts 28 are preferred, other known fasteners may be used instead. It is preferred that the fasteners have solid heads or at least thick-walled heads in order to provide a more secure mounting arrangement than the thin-walled hollow rivets of the prior art. Also, while these embodiments show a separate backing bar 20, the trowel arm 18 itself could be designed to serve as the backing bar, eliminating the need for a separate backing bar.

What is claimed is:

1. A blade assembly for a motorized trowel, comprising:

a substantially flat sheet of material forming an elongated blade, having a top surface and a bottom surface and defining a plurality of in-line holes spaced at intervals along the length of the blade; wherein the sheet is deformed upwardly surrounding the holes to form a tapered depression in the bottom surface surrounding the holes and a tapered projection in the top surface surrounding the holes; and a backing bar having a substantially flat bottom surface and defining a plurality of openings aligned with the holes in said blade, said openings being countersunk to receive the projections on the top surface of the blade;

wherein at least one of the openings and holes defines a non-circular cross section portion.

2. A blade assembly for a motorized trowel as recited in claim 1, wherein said non-circular cross section portions are in said openings of said backing bar.

3. A blade assembly for a motorized trowel as recited in claim 2, wherein the countersunk surfaces of the backing bar have the same tapered shape as the tapered projections on the top surface of the blade so as to receive the projections with a snug fit.

4. A blade assembly for a motorized trowel as recited in claim 3, and further comprising a plurality of fasteners extending through the blade into the backing bar, each of said fasteners having a head, extending up into the respective tapered depression of the blade and clamping the tapered projection of the blade against the countersunk surface of the backing bar, and a non-circular cross section shaft portion extending through the respective non-circular cross section opening portion in the backing bar such that the shaft is prevented from rotating relative to the backing bar.

5. A blade assembly for a motorized trowel as recited in claim 4, and further comprising a motorized trowel arm including a plurality of through holes, wherein said holes in said blade are aligned with the through holes in said arm and with the openings in said backing bar, and said trowel arm through holes receive said fasteners which extend through said through holes to fasten said blades and backing bars onto the trowel arm.

6. A blade for a motorized trowel as recited in claim 1, wherein the openings in the backing bar which receive the projections have substantially the same shape as the tapered projections so as to receive the projections with a snug fit.

7. A blade for a motorized trowel as recited in claim 6, and further comprising a plurality of fasteners extending through the holes in the blade into the openings in the backing bar, each of said fasteners having a head, extending up into the respective tapered depression of the blade and clamping the tapered projection of the blade against the backing bar, and a non-circular cross section shaft portion extending through the respective non-circular cross-sectional shape portion of said blade and backing bar such that the shaft is prevented from rotating.

8. A trowel blade for a motorized trowel, comprising:

a backing bar, having a substantially flat bottom surface and a substantially flat top surface, and defining a plurality of openings extending from said bottom surface to said top surface, said openings defining non-circular cross section portions, wherein said bottom surface defines indentations surrounding said openings;

a blade, defining a plurality of holes aligned with the openings in said backing bar, said blade having a substantially flat top surface and a substantially flat bottom surface; and a plurality of bolts, each bolt having an enlarged head, a threaded end portion, and a non-circular cross section neck portion between the head and the threaded end, and each bolt extending upwardly from the bottom surface of said blade, through its respective hole in the blade, and through its respective non-circular cross section opening in the backing bar, wherein the non-circular cross section neck portion of the bolt is sized and shaped to prevent rotation of the bolt relative to the non-circular cross section opening in the backing bar, and wherein, when the bolt is tightened, the head of the bolt clamps the blade against the backing bar.

9. A trowel blade as recited in claim 8, wherein the top surface of said backing bar also defines indentations surrounding said non-circular cross section openings, and wherein the indentations in the top surface have a smaller diameter than the corresponding indentations in the bottom surface.

10. A trowel blade for a motorized trowel as recited in claim 8, wherein the surfaces of the blade surrounding the holes are deformed upwardly, defining projections in the top surface of the blade, which project into the indentations in the backing bar, and defining recesses in the bottom surface of the blade which receive the bolt heads that clamp the upwardly-projecting portion of the blade against the respective tapered indentation in the backing bar.

11. A trowel blade as recited in claim 8, and further comprising a motorized trowel machine including at least one trowel arm defining a plurality of mounting holes, wherein said holes in said blade and said openings in said backing bar are aligned with the trowel arm holes, and said bolts extend through said trowel arm holes; and a plurality of nuts securing said bolts to said trowel arm.

* * * * *

UNITED STATES PATENT AND TRADEMARK OFFICE

CERTIFICATE OF CORRECTION

PATENT NO. : 6,419,419 B1
DATED : July 16, 2002
INVENTOR(S) : Gordon Kelsay, III It is certified that error appears in the above-identified patent and that said Letters Patent is hereby corrected as shown below:

Column 2,
Line 3, delete “radiall-extending” and insert therefor -- radially-extending --.
Line 14, following “20A”, insert -- by contacting the edge --.

Signed and Sealed this

Sixteenth Day of December, 2003

JAMES E. ROGAN
*Director of the United States Patent and Trademark Office*